US006120397A

United States Patent [19]

Julian

[11] Patent Number: 6,120,397

[45] Date of Patent: Sep. 19, 2000

[54] TABLE TENNIS TABLE TOP WITH PIVOTAL LEGS

[75] Inventor: David Lee Julian, Evansville, Ind.

[73] Assignee: Indian Industries, Inc., Evansville, Ind.

[21] Appl. No.: 09/010,402

[22] Filed: Jan. 21, 1998

[51] Int. Cl.[7] ..... A63B 67/04

[52] U.S. Cl. ..... 473/496

[58] Field of Search ..... 108/116, 115, 108/118, 119, 121, 127; 473/496

[56] References Cited

U.S. PATENT DOCUMENTS

| | | | |
|---|---|---|---|
| 2,569,007 | 9/1951 | Klyce | 311/89 |
| 2,675,635 | 4/1954 | Toth | 108/116 X |
| 3,190,649 | 6/1965 | Heisler | 273/30 |
| 3,823,938 | 7/1974 | Unno | 273/30 |
| 3,830,495 | 8/1974 | Hill | 273/30 |
| 4,089,522 | 5/1978 | Rock | 273/30 |
| 4,762,321 | 8/1988 | Chang | 473/496 |
| 4,949,649 | 8/1990 | Terres et al. | 108/116 |
| 5,020,799 | 6/1991 | Chang | 273/3 |
| 5,375,837 | 12/1994 | Moreau | 273/30 |

*Primary Examiner*—Sam Rimell

*Attorney, Agent, or Firm*—Woodard, Emhardt, Naughton, Moriarty & McNett

[57] ABSTRACT

An apparatus useful for playing table tennis. The apparatus includes a table top with a first pair of T-shaped legs. The first pair of legs are pivotally mounted to the bottom surface of the table top and are capable of pivoting about two axes. A second pair of legs capable of pivoting about one axis are also attached to the bottom surface of the table top. All four legs have a first position folded against the bottom surface of the table top. All four legs have a position unfolded from the table top that supports the weight of the table top when table tennis is being played. The pair of T-shaped legs also have a position in which they are pivoted such that the crossmember of the T-shape extends beyond an edge of the table top. The T-shaped legs are thus capable of supporting the table top when the table top is substantially vertical.

45 Claims, 6 Drawing Sheets

TABLE TENNIS TABLE TOP WITH PIVOTAL LEGS

BACKGROUND OF THE INVENTION

This invention relates to table tops suitable for table tennis, especially those table tops that can be stored vertically.

One problem with table tops for playing table tennis concerns storage of the table tops when they are not in use. The legs that support the table tops can sometimes be folded against the table top, although some of these designs require that the table top with folded legs then be carried to a storage location. Other designs permit the table top to be pivoted to a vertical position and supported on a pair of legs. Some of these designs include multiple crosslinks between legs. These crosslinks increase the overall weight and cost of the assembly. In addition, in some designs the legs cannot be folded such that they lie flat against the table top within the edges of the table top. These designs require additional space and expense during shipment.

What is needed is a table top for table tennis that overcomes the disadvantages of currently available table tennis table tops. The present invention does this in a novel and unobvious way.

SUMMARY OF THE INVENTION

One aspect of the present invention concerns an apparatus comprising a table top with a top surface. The top surface has about one-half of a surface suitable for playing table tennis. The apparatus includes a first pair of pivotal legs coupled to the table top with each leg of the first pair of pivotal legs being pivotal in two directions. The apparatus also includes a second pair of pivotal legs coupled to the table top with each leg of the second pair of pivotal legs being pivotal in at least one direction.

One object of the present invention is to provide an improved apparatus for table tennis.

These and other objects and advantages of the present invention will be apparent from the description of the drawings, the description of the preferred embodiment, and the claims to follow.

DESCRIPTION OF THE PREFERRED EMBODIMENT

Figure 1:
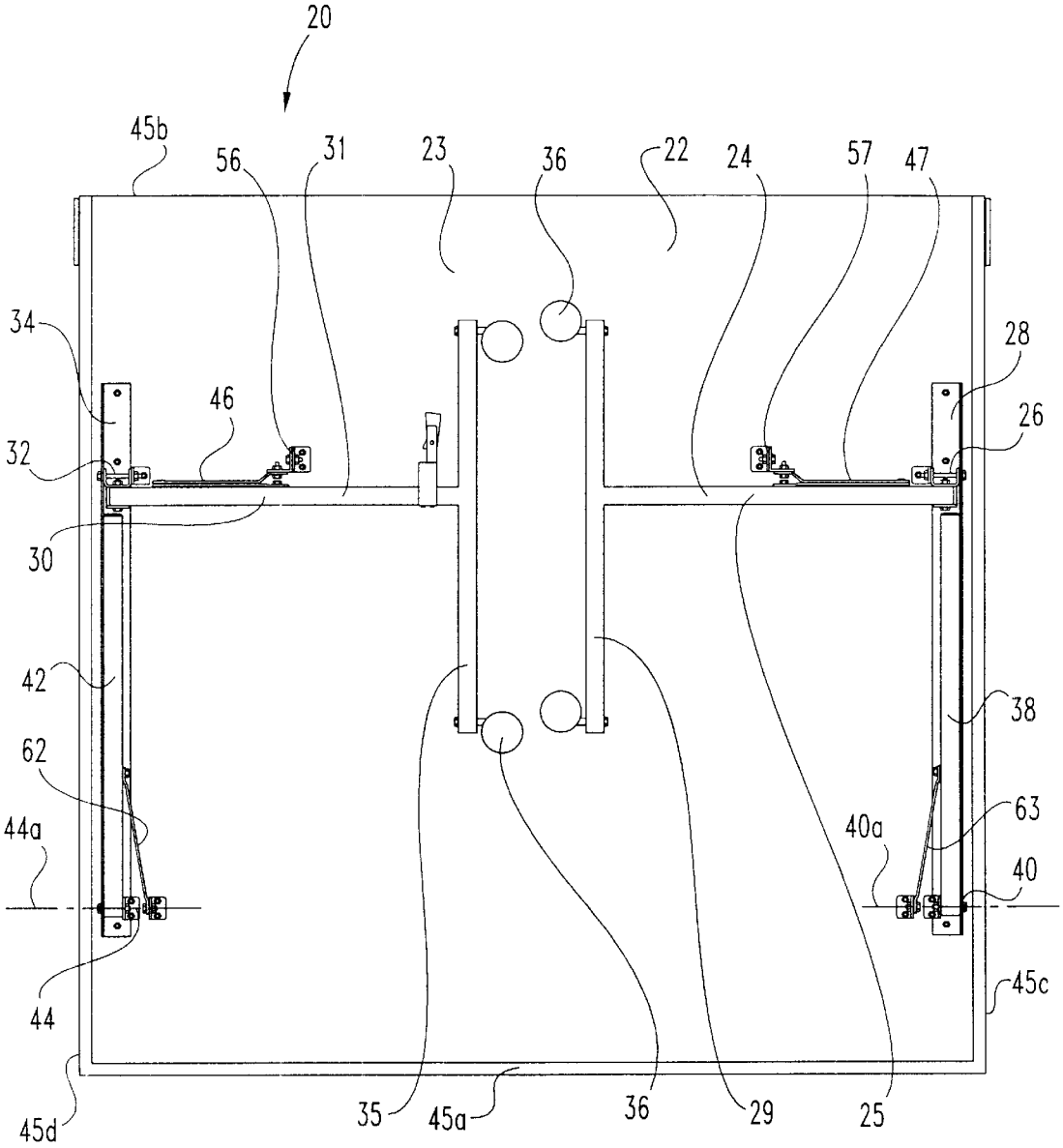
FIG. 1 shows a bottom plan view of an apparatus useful in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an apparatus useful for playing table tennis wherein the apparatus can be stored for shipping in a compact manner, and also can be stored in a compact and easily moveable form after shipping when the apparatus is not in use. The apparatus includes a table top with a top surface that has about one-half of the total surface for playing table tennis. This table top is supported by four legs and is releaseably connected to a similar apparatus when table tennis is being played. When not in use, the two joined apparatus may be disconnected from one another and each table top is pivoted to a substantially vertical position. Two of the four legs are then folded against the bottom surface of the table top while the other two legs support the vertical table top. These two supporting legs are in contact with the floor through rolling elements, and the apparatus may be easily moved on the rolling elements to a storage location. In this vertical storage position the two apparatus may be nested closely together so as to minimize storage space.

FIG. 1 shows a bottom plan view of an apparatus useful in accordance with the present invention. FIG. 1 depicts apparatus 20, which comprises one-half of a table tennis assembly. Apparatus 20 includes a substantially flat table top 22 with a bottom surface 23. Table top 22 has a length from edge 45*a* to 45*b* that is about one-half of the length suitable for playing table tennis. Table top 22 has a width perpendicular to this length that is suitable for playing table tennis.

A first pivotal leg 24 is coupled by universal joint 26 through an angle iron 28 to table top 22. Apparatus 20 also includes a second pivotal leg 30 coupled by universal joint 32 through angle iron 34 to bottom surface 23 of table top 22. Pivotal legs 24 and 30 are preferably coupled to table top 22 near opposing edges 45*c* and 45*d*, respectively, of table top 22. As shown in FIG. 1, legs 24 and 30 are in a first position folded against bottom surface 23.

Pivotal leg 24 is generally in the shape of the letter T and includes an upright section 25 which is substantially perpendicular to a crossmember 29. Pivotal leg 30 is generally in the shape of the letter T and includes an upright section 31 which is substantially perpendicular to crossmember 35.

A third pivotal leg 38 is coupled by pivot joint 40 through angle iron 28 to table top 22. A fourth pivotal leg 42 is coupled by pivot joint 44 through angle iron 34 to table top 22. Pivot joints 40 and 44 permit legs 38 and 42, respectively, to pivot in a direction relative to table top 22 about axes 40*a* and 44*a*, respectively. Pivotal legs 38 and 42 are preferably coupled to table top 22 near opposing edges 45*c* and 45*d*, respectively, of table top 22. Legs 38 and 42 are shown in FIG. 1 in a first position folded against bottom surface 23.

As shown in FIG. 1, legs 24, 30, 38, and 42 may all be folded flat against bottom surface 23 of table top 22. No portion of legs 24, 30, 38 or 42 extends beyond any of the edges 45*a*, 45*b*, 45*c*, or 45*d* of table top 22. By maintaining the folded legs within the edges as shown in FIG. 1, apparatus 20 may be shipped and stored in a container of minimal volume.

Figure 2:
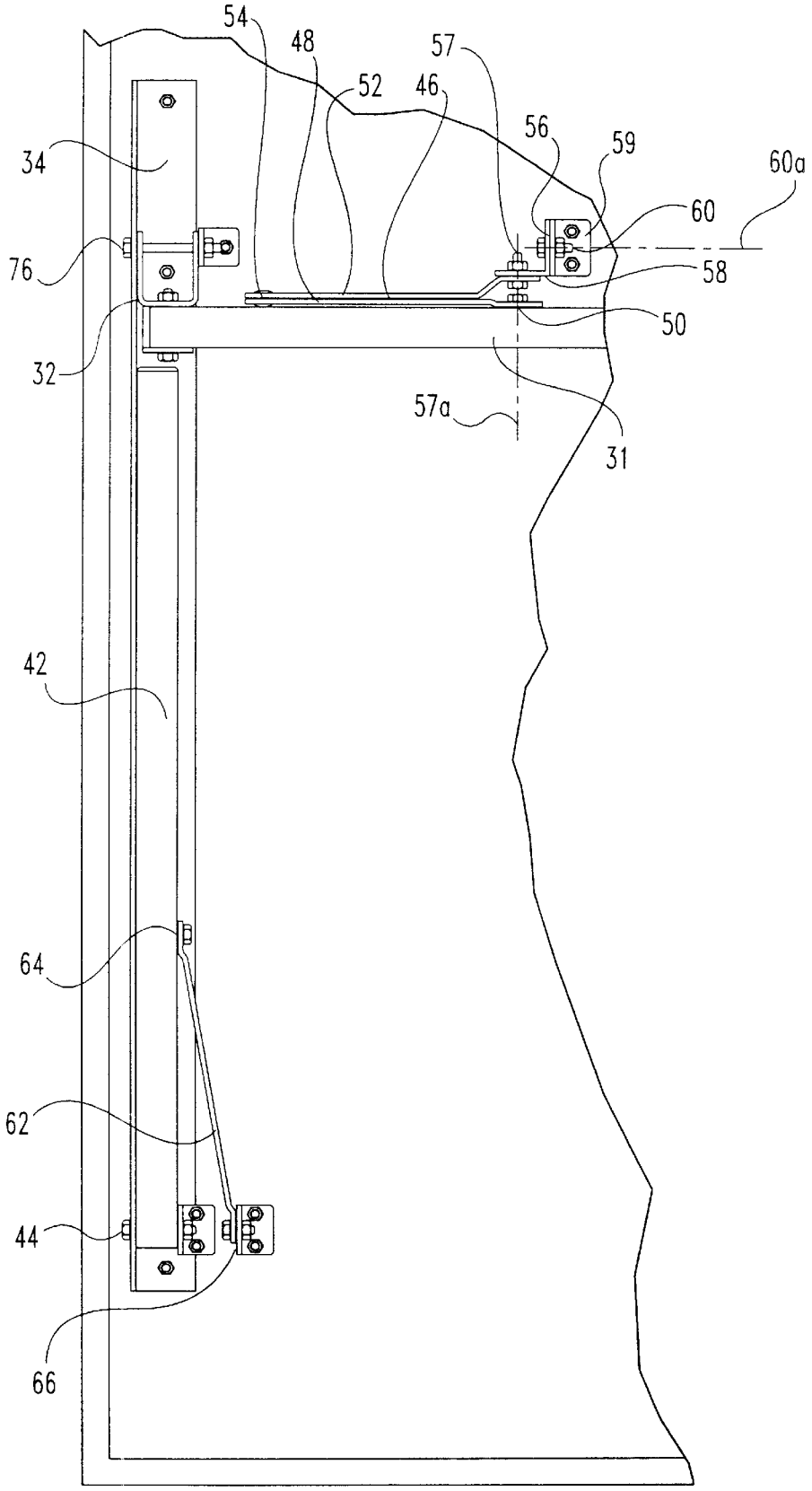
FIG. 2 is a bottom plan view of a portion of the apparatus of FIG. 1.

FIG. 2 is a bottom plan view of a portion of the apparatus of FIG. 1. A scissors-type strut 46 comprises a first member 48 coupled to a second member 52 by pivoting joint 54. Strut 46 is coupled at one end to upright section 31 of leg 30 and at the other end to bottom surface 23 of table top 22. The first end of strut 46 is attached to upright section 31 by pivot joint 50 which permits first member 48 to pivot in one direction relative to leg 30.

Figure 4:
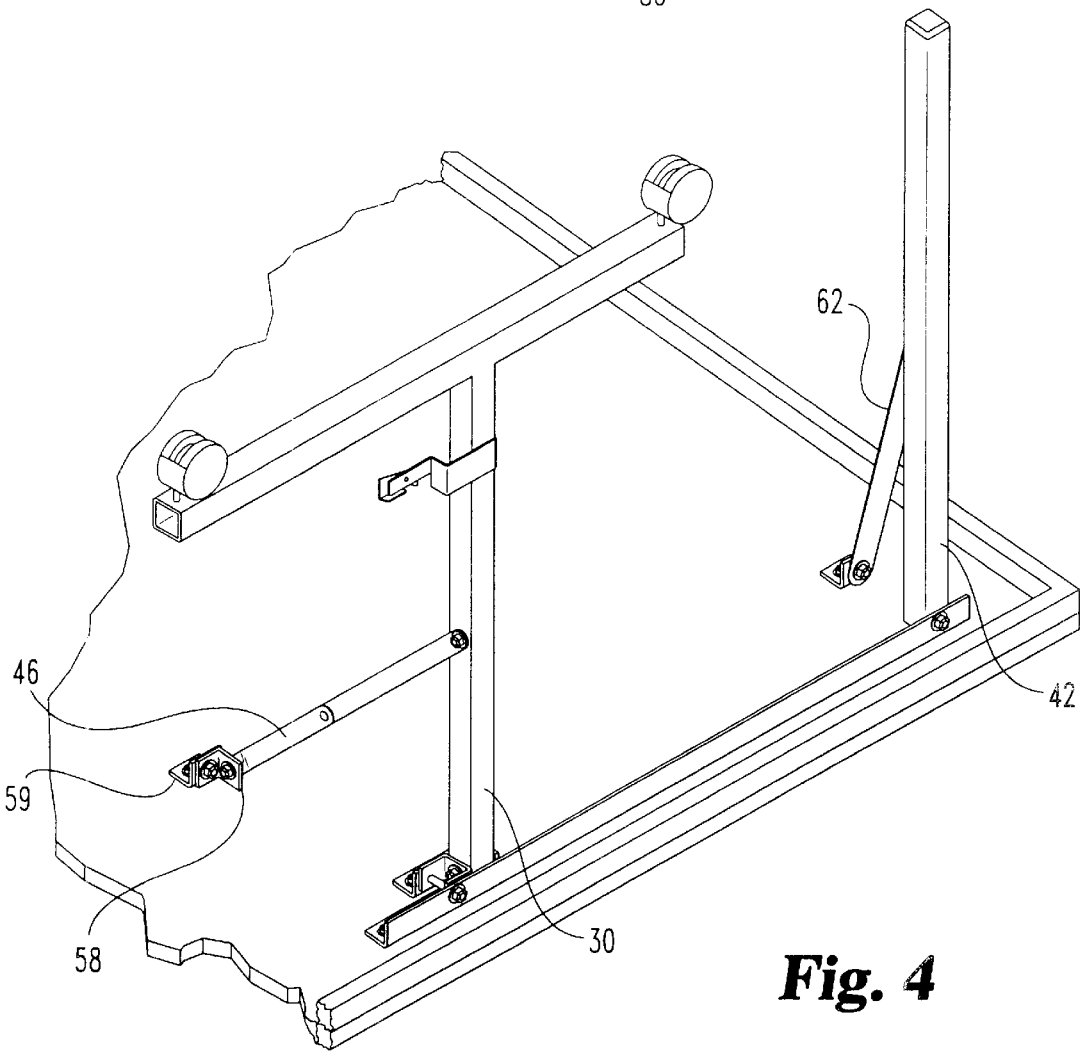
FIG. 4 is a bottom perspective view of a portion of the apparatus of FIG. 1.

The second end of strut 46 is pivotally coupled to table top 22 by universal joint 56. As can be seen in FIGS. 2 and 4, universal joint 56 permits strut 46 to pivot in two directions relative to table top 22. Strut 46 is coupled to universal joint 56 by a pivot joint 57 to first L-bracket 58 and is able to pivot in a direction about axis 57*a*. First L-bracket 58 is coupled to second L-bracket 59 by pivot joint 60, joint 60 permitting pivoting in a direction about axis 60*a*. L-bracket 59 is fastened to bottom surface 23 of table top 22. Pivot joints 57 and 58 are substantially perpendicular to one another and thus permit strut 46 to pivot in two directions relative to table top 22. Apparatus 20 includes a second strut 47 which is pivotally coupled to both leg 24 and table top 22 in a manner similar to that described for strut 46. A universal joint 57 couples strut 47 to table top 22 in a manner similar to that described for universal joint 56.

Strut 46 is a scissors-type strut, such that members 48 and 52 are substantially side by side when leg 30 is folded against bottom surface 23. When leg 30 is unfolded so as to support a portion of the weight of apparatus 20, struts 48 and 52 are substantially co-linear, as best seen in FIG. 4. A locking mechanism (not shown) proximate to pivot joint 54 maintains numbers 48 and 58 in the extended, co-linear position. Although struts 46 and 47 have been shown and described as scissors-type struts, the present invention also contemplates struts in which one end of the strut is slidably coupled to table top 22, such that the strut is slidable along a rail attached to table top 22.

A strut 62 provides additional stability for the support of apparatus 20 by pivoting leg 42. Strut 62 is pivotally coupled to leg 42 by pivot joint 64 as seen in FIG. 2. Strut 62 is also coupled to table top 22 by pivot joint 66. The pivot axis of joint 66 is substantially co-linear with the pivot axis of joint 44 of leg 42. Apparatus 20 includes strut 63 attached to pivotal leg 38 in a manner similar to that described for strut 62.

Figure 3:
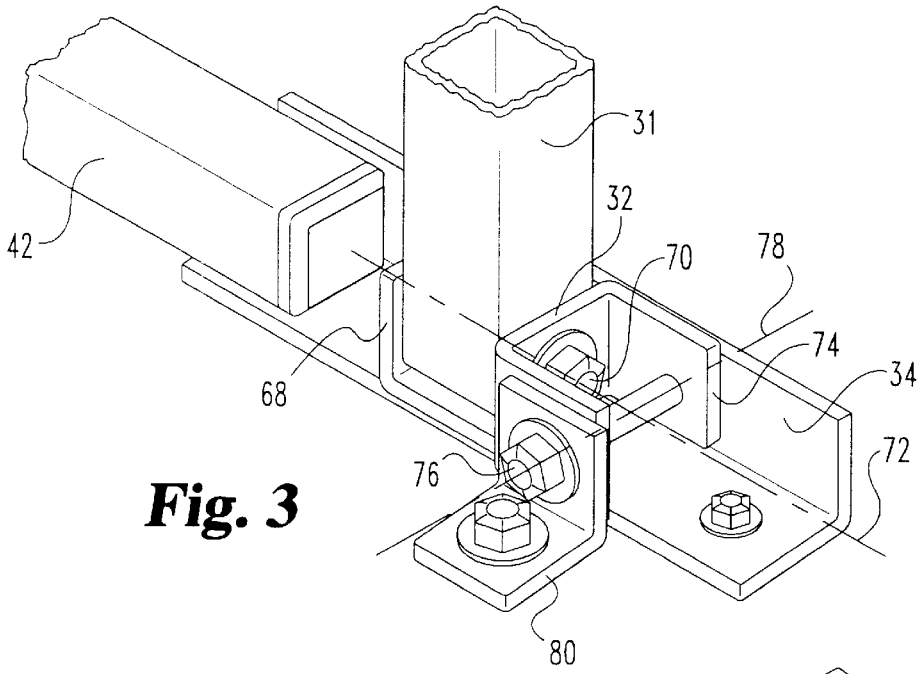
FIG. 3 is a closeup bottom perspective view of a universal joint useful in accordance with the present invention.

FIG. 3 shows a closeup of apparatus 20 in the vicinity of universal joint 32, with pivotal leg 30 unfolded such that section 31 is substantially perpendicular to bottom surface 23. Universal joint 32 includes a first C-channel 68 sized so as to accept a portion of upright section 31 within C-channel 68. A pivot joint 70 pivotally couples C-channel 68 to section 31 and permits leg 30 to pivot in a direction about first axis 72. Universal joint 32 also includes a second C-channel 74, a portion of C-channel 74 being integral with a portion of C-channel 68. Second C-channel 74 is pivotally coupled by pivot joint 76 to L bracket 80. Both leg 30 and C-channels 68 and 74 can thus pivot in a direction about second axis 78. Second axis 78 is generally perpendicular to first axis 72. Universal joint 32 permits pivotal leg 30 to pivot in two directions relative to table top 22. Pivot axis 78 of universal joint 32 is substantially aligned with the pivot axis of pivot joint 60. The alignment permits leg 30 and strut 46 to pivot together. Apparatus 20 includes universal joint 26 for coupling pivotal leg 24 to table top 22 in a manner similar to that described for universal joint 32.

Although universal joints 32 and 26 have been shown and described as an integration of a first C-channel and a second C-channel, those of ordinary skill in the art will recognize that there are additional means for universally joining legs 24 and 30 to table top 22. By way of example only, means for universally joining includes universal joints similar to universal joints 32 and 26, the combination of L brackets and pivot joints heretofore described for universal joints 56 and 57, and also a universal joint comprising a ball and socket.

Figure 7:
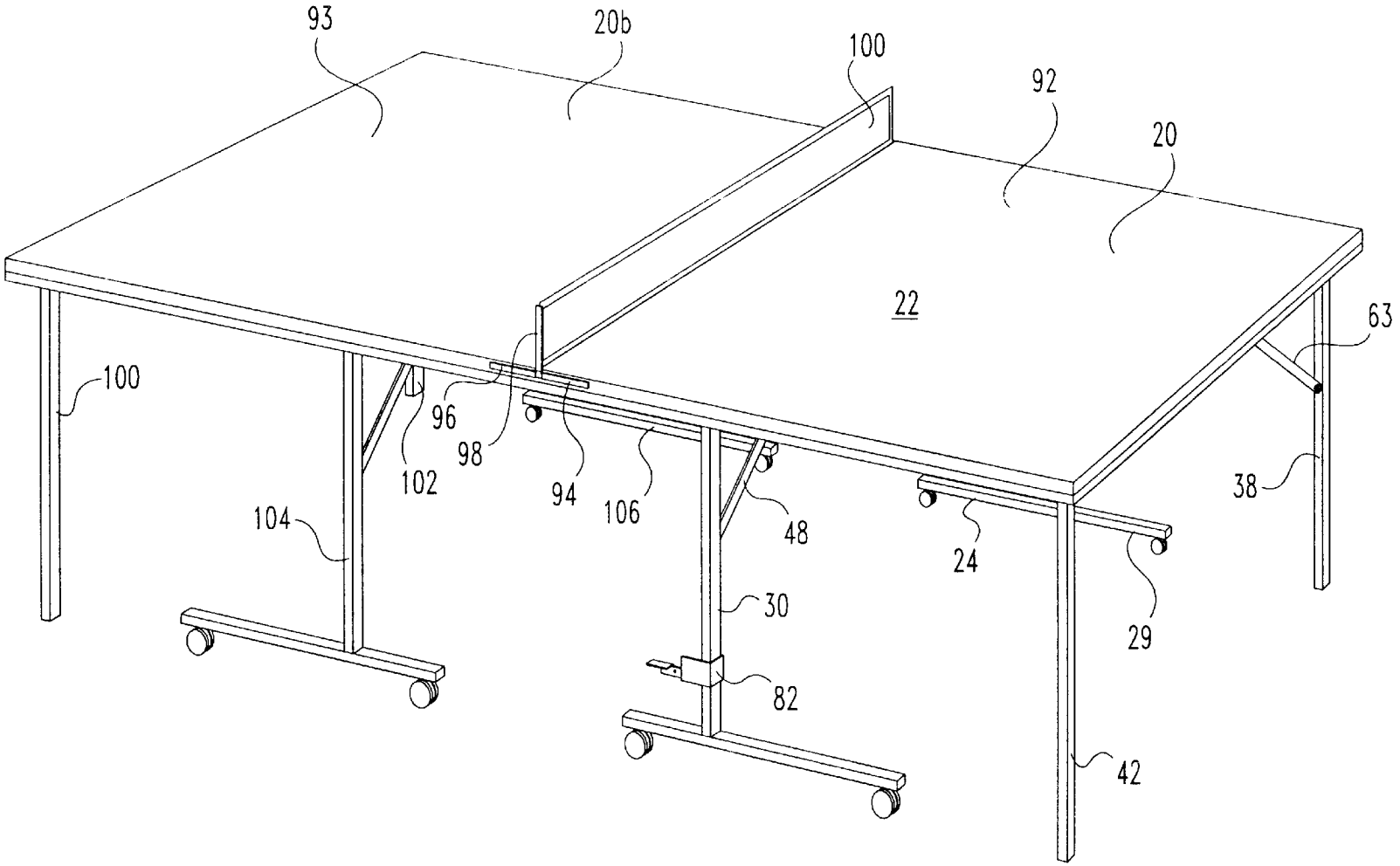
FIG. 7 is a top and side perspective view of the apparatus of FIG. 1 releaseably connected to a similar apparatus.

FIG. 4 depicts apparatus 20 with legs 30 and 42 unfolded to a second position from and generally perpendicular to bottom surface 23. Leg 30 is shown pivoted in one direction about axis 72. Strut 46 is locked by a locking mechanism (not shown) to an extended and substantially co-linear position. Locking of member 48 to member 52 inhibits pivoting of leg 30 about axis 72. However, even when strut 46 is locked, leg 30 is able to pivot about axis 78. Leg 42 is shown pivoted about joint 44. With legs 30 and 42 so unfolded, and also with legs 24 and 38 similarly unfolded, apparatus 20 may be turned over with legs 24, 30, 38, and 42 thus supporting table top 22 in a substantially horizontal position, as shown in FIG. 7.

Figure 5:
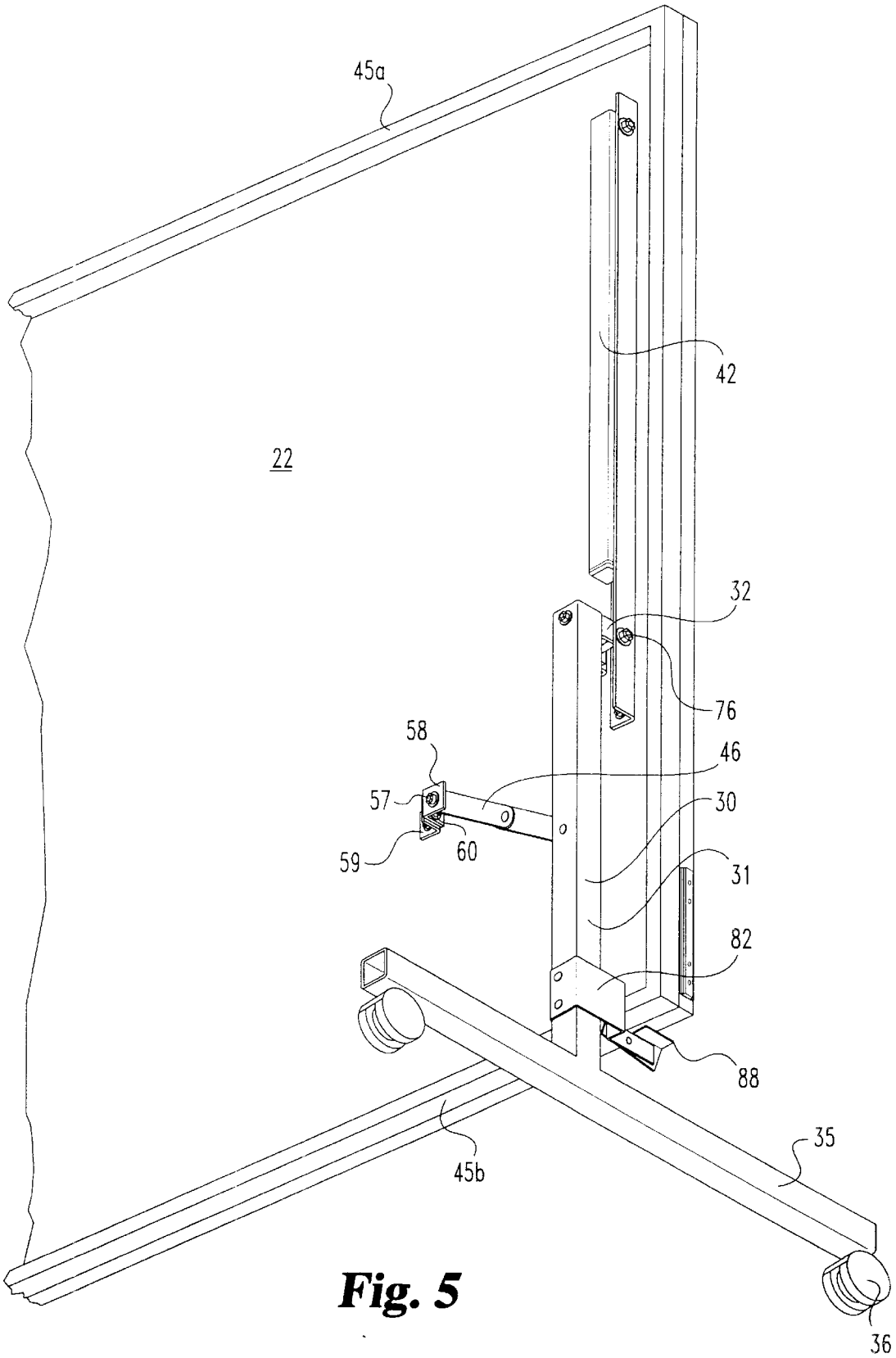
FIG. 5 is a perspective view of the apparatus of FIG. 1 with the table top being supported vertically.

FIG. 5 depicts leg 30 unfolded from bottom surface 23 of table top 22, and pivoted about axis 78 to a third position. Strut 46 is extended and locked so as to prevent pivoting of leg 30 about axis 72. The length of upright section 31 of leg 30 is chosen so that the distance from pivot joint 76 to crossmember 35 is greater than the distance from pivot joint 76 to edge 45*b* of table top 22. Table top 22 is thus free to pivot about joint 76 and not interfere with crossmember 35. With legs 30 and 24 so positioned, table top 22 is supported by legs 30 and 24 in a first position in a substantially vertical manner. Rolling elements 36 permit apparatus 20 to be easily moved on a floor. A second apparatus 22 with its table top likewise in a substantially vertical position may be closely nested to a first apparatus 20 so as to minimize storage space for pair of apparatus.

Figure 6:
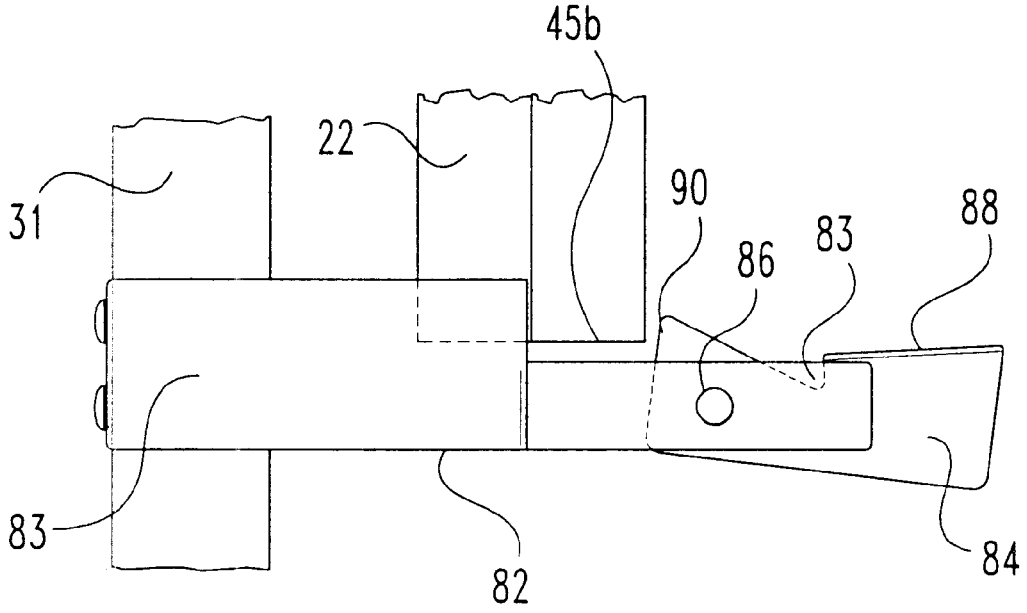
FIG. 6 is a side elevational view of a portion of the apparatus of FIG. 5.

Bracket assembly 82 attached to upright section 31 is useful for maintaining table top 22 in a substantially vertical position, as shown in FIG. 6. Bracket assembly 82 includes a bracket portion 83 attached to upright section 31 of leg 30. Bracket assembly 82 also includes a latch 84 pivotally coupled to bracket 83 by pin 86. Pin 86 pivotally couples latch 84 such that a majority of the weight of latch 84 is located to one side of pin 86 as shown in FIG. 6. Latch 84 includes a lifting edge 88 which is generally perpendicular to the portion of latch 84 pivotally coupled to bracket 83, as best seen in FIGS. 4 and 5.

As shown in FIG. 5, the weight of latch 84 causes lifting edge 88 to pivot into contact with a portion of bracket 83 such that restraining corner 90 of latch 84 pivots upward. As table top 22 is rotated to a substantially vertical position, edge 45*b* comes into contact with restraining corner 90, causing latch 84 to pivot such that restraining corner 90 passes underneath edge 45*b*. Once table top 22 is between restraining corner 90 and upright section 31, latch 84 again rotates under the influence of gravity such that restraining corner 90 pivots upward and prevents table top 22 from pivoting back to a horizontal position. Table top 22 may be released by moving lifting edge 88 upward such that restraining corner 90 drops below edge 45*b*.

FIG. 7 is a top and side perspective view of apparatus 20 of FIG. 1 releaseably connected to a similar apparatus 20*b*. Apparatus 20 has been configured with table top 22 in a second, substantially horizontal position and being supported by legs 24, 30, 38, and 42 such that bottom surface 23 is facing a floor and top surface 92 of table top 22 is facing upward. A second apparatus 20*b* which includes a second table top 93 is similarly supported by its legs 100, 102, 104, and 106. Legs 104 and 106 are similar to legs 30 and 24, and legs 100 and 102 are similar to legs 42 and 38.

Table top 22 is releaseably connected to table top 93 by latch members located proximate to edge 45*b* of table top 22 and the mating edge of table top 93. As depicted in FIG. 7, latch member 94 of table top 22 releaseably connects to latch member 96 of table top 93. A pivotal latch member 98 is shown pivoted to an upright position and locking latch members 94 and 96 together. Pivotal latch 98 is useful to support one end of a net 100 which divides the total table tennis playing area into two halves. A similar latching mechanism (not shown) releaseably connects table top 22 to table top 93 along the opposing edge.

It is preferable that legs 24 and 30 be located between edges 45*a* and 45*b* of table top 22 such that a majority of the weight of apparatus 20 is located along the length of table top 22 between edge 45*a* and legs 24 and 30. By so locating the majority of weight, or the center of gravity, along the length of table top 22 a portion of the weight of apparatus 20 will be supported by legs 38 and 42, and thus enhance the stability of apparatus 20 and reduce loading on latch members 94, 96, and 98 when table top 20 is horizontal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus comprising:

a table top, said table top having a top surface, the top surface having about one half of a surface suitable for playing table tennis;

a first pair of pivotal legs coupled to said table top, each of said first pair of pivotal legs being pivotal about two axes;

a second pair of pivotal legs coupled to said table top, each of said second pair of pivotal legs being pivotal about at least one axis; and a pair of struts, each of said struts having two ends, the first end of one of said struts being coupled to one of said first pair of pivotal legs and the first end of the other of said struts being coupled to the other of said first pair of pivotal legs, the second end of the one said strut being pivotally coupled to said table top and capable of pivoting about two axes and the second end of the other said strut being pivotally coupled to said table top and capable of pivoting about two axes.

2. The invention of claim 1 wherein said first pair of pivotal legs are pivotal about a first axis and said first pair of pivotal legs are pivotal about a second axis, and the first axis is generally perpendicular to the second axis.

3. The invention of claim 1 wherein said table top has a first position which is substantially vertical, and said first pair of pivotal legs are capable of supporting said table top when said table top is substantially vertical.

4. The invention of claim 3 which further comprises a pair of rollers on each said first pair of pivotal legs.

5. The invention of claim 1 wherein said table top includes a bottom surface, and said first pair of pivotal legs have a first position folded against the bottom surface and said second pair of legs have a first position folded against the bottom surface, said first pair of pivotal legs and said second pair of pivotal legs capable of supporting said table top.

6. An apparatus for playing table tennis, comprising:

a table top having a top surface suitable for table tennis;

a first pair of universal joints attached to said table top, each of said universal joints allowing pivoting about two axes;

a first pair of legs, one of said first pair of legs being attached to one of said universal joints and the other of said first pair of legs being attached to the other of said universal joints; and a second pair of legs pivotally attached to said table top.

7. The apparatus of claim 6 wherein each of said universal joints are pivotal about a first axis and each of said universal joints are pivotal about a second axis, and the first axis is generally perpendicular to the second axis.

8. The apparatus claim 6 wherein said table top has a first position which is substantially vertical, and said first pair of legs support said table top when said table top is substantially vertical.

9. The apparatus of claim 8 which further comprises a pair of rollers on each leg of said first pair of legs.

10. The apparatus of claim 6 which further comprises:

a second pair of universal joints attached to said table top, each of said second pair of universal joints allowing pivoting about two axes; and a pair of struts, one of said struts being attached to one of said second pair of universal joints and being attached to one of said first pair of legs, and the other of said struts being attached to the other of said second pair of universal joints and being attached to the other of said first pair of legs.

11. An apparatus for playing table tennis, comprising:

a table top having a width suitable for playing table tennis and a length that is about one half of the length suitable for playing table tennis;

a pair of pivoting legs, each leg of said pair of pivoting legs being pivotable about at least one axis; and a pair of struts, each of said struts having two ends, the first end of one of said struts being coupled to one of said pivoting legs and the first end of the other of said struts being coupled to the other of said pivoting legs, the second end of the one said strut being pivotally coupled to said table top and capable of pivoting about two axes and the second end of the other said strut being pivotally coupled to said table top and capable of pivoting about two axes.

12. The apparatus of claim 11 which further comprises a second pair of legs.

13. The apparatus of claim 11 wherein each leg of said pair of pivoting legs are pivotable about two axes.

14. The apparatus of claim 11 wherein said table top has a first position which is substantially vertical and which is supported by said pair of pivoting legs.

15. An apparatus comprising:

a first table top;

a first pivoting leg pivotally coupled to said first table top, said first pivoting leg capable of pivoting about two axes, said first pivoting leg being generally in a T shape; and a second pivoting leg pivotally coupled to said first table top, said second pivoting leg capable of pivoting about two axes, said second pivoting leg being generally in a T shape.

16. The invention of claim 15 which further comprises:

a second table top;

a third pivoting leg pivotally coupled to said second table top, said third pivoting leg capable of pivoting about two axes, said third pivoting leg being generally in a T shape; and a fourth pivoting leg pivotally coupled to said second table top, said fourth pivoting leg capable of pivoting about two axes, said fourth pivoting leg being generally in a T shape;

wherein said first table top is capable of being releaseably connected to said second table top to form a surface suitable for table tennis.

17. The apparatus of claim 15 wherein said first table top has a first position which is substantially vertical, and said first pivoting leg and said second pivoting leg are capable of supporting said first table top when said first table top is substantially vertical.

18. The apparatus of claim 16 wherein said second table top has a first position which is substantially vertical, and said first pivoting leg and said fourth pivoting leg are capable of supporting said second table top when said second table top is substantially vertical.

19. The invention of claim 2 wherein said table top has a first position which is substantially vertical, and said first pair of pivotal legs are capable of supporting said table top when said table top is substantially vertical.

20. The invention of claim 19 which further comprises a pair of rollers on each said first pair of pivotal legs.

21. The invention of claim 20 wherein said table top includes a bottom surface, and said first pair of pivotal legs have a first position folded against the bottom surface and said second pair of legs have a first position folded against the bottom surface.

22. The apparatus of claim 8 wherein each of said universal joints are pivotal about a first axis and each of said universal joints are pivotal about a second axis, and the first axis is generally perpendicular to the second axis.

23. The apparatus of claim 22 which further comprises a pair of rollers on each leg of said first pair of legs.

24. The apparatus of claim 23 which further comprises:

a second pair of universal joints attached to said table top, each of said second pair of universal joints allowing pivoting about two axes; and a pair of struts, one of said struts being attached to one of said second pair of universal joints and being attached to one of said first pair of legs, and the other of said struts being attached to the other of said second pair of universal joints and being attached to the other of said first pair of legs.

25. The apparatus of claim 13 wherein said table top has a first position which is substantially vertical and which is supported from a floor by said pair of pivoting legs.

26. The apparatus of claim 25 which further comprises a second pair of legs.

27. The invention of claim 16 wherein said first table top has a width suitable for playing table tennis and a length that is about one half of the length suitable for playing table tennis, and said second table top has a width suitable for playing table tennis and a length that is about one half of the length suitable for playing table tennis.

28. The apparatus of claim 27 wherein said first table top has a first position which is substantially vertical, and said first pivoting leg and said second pivoting leg are capable of supporting said first table top when said first table top is substantially vertical, and second table top has a first position which is substantially vertical, and said third pivoting leg and said fourth pivoting leg are capable of supporting said second table top when said second table top is substantially vertical.

29. The apparatus of claim 21 wherein each of said first pair of pivotal legs are generally in a T shape.

30. The apparatus of claim 26 wherein each of said first pair of legs are generally in a T shape.

31. The apparatus of claim 28 wherein each of said pair of pivoting legs are generally in a T shape, and which further comprises a pair of rollers on each said pair of pivoting legs.

32. The apparatus of claim 30 which further comprises a first pair of rollers on said first pivoting leg, a second pair of rollers on said second pivoting leg, a third pair of rollers on said third pivoting leg, and a fourth pair of rollers on said fourth pivoting leg.

33. An apparatus comprising:

a table top, said table top having a top surface, the top surface having about one half of a surface suitable for playing table tennis;

a first pair of pivotal legs coupled to said table top, each of said first pair of pivotal legs being pivotal about two axes; and a second pair of pivotal legs coupled to said table top, each of said second pair of pivotal legs being pivotal about at least one axis;

wherein said first pair of pivotal legs are pivotal about a first axis and said first pair of pivotal legs are pivotal about a second axis, and the first axis is generally perpendicular to the second axis.

34. The invention of claim 33 wherein said table top has a first position which is substantially vertical, and said first pair of pivotal legs are capable of supporting said table top when said table top is substantially vertical.

35. The invention of claim 34 which further comprises a pair of rollers on each of said first pair of pivotal legs.

36. The invention of claim 35 wherein said table top includes a bottom surface, and said first pair of pivotal legs have a first position folded against the bottom surface and said second pair of pivotal legs have a first position folded against the bottom surface, said second pair of pivotal legs being capable of supporting said table top.

37. The invention of claim 36 which further comprises:

a pair of struts, each of said struts having two ends, the first end of one of said struts being coupled to one of said first pair of pivotal legs and the first end of the other of said struts being coupled to the other of said first pair of pivotal legs, the second end of the one said strut being pivotally coupled to said table top and capable of pivoting about two axes and the second end of the other said strut being pivotally coupled to said table top and capable of pivoting about two axes.

38. The invention of claim 33 which further comprises a pair of rollers on each of said first pair of pivotal legs for supporting said table top.

39. The invention of claim 33 wherein said table top includes a bottom surface, and said first pair of pivotal legs have a first position folded against the bottom surface and said second pair of pivotal legs have a first position folded against the bottom surface, said second pair of pivotal legs being capable of supporting said table top.

40. An apparatus comprising:

a table top, said table top having a top surface, the top surface having about one half of a surface suitable for playing table tennis;

a first pair of pivotal legs coupled to said table top, each of said first pair of pivotal legs being pivotal about two axes; and a second pair of pivotal legs coupled to said table top, each of said second pair of pivotal legs being pivotal about at least one axis;

wherein said table top has a first position which is substantially vertical, and said first pair of pivotal legs are capable of supporting said table top when said table top is substantially vertical.

41. The invention of claim 40 which further comprises a pair of rollers on each said first pair of pivotal legs for supporting said table top.

42. The invention of claim 41 wherein said table top includes a bottom surface, and said first pair of pivotal legs have a first position folded against the bottom surface and said second pair of pivotal legs have a first position folded against the bottom surface, said second pair of pivotal legs being capable of supporting said table top.

43. The invention of claim 42 which further comprises:

a pair of struts, each of said struts having two ends, the first end of one of said struts being coupled to one of said first pair of pivotal legs and the first end of the other of said struts being coupled to the other of said first pair of pivotal legs, the second end of the one said strut being pivotally coupled to said table top and capable of pivoting about two axes and the second end of the other said strut being pivotally coupled to said table top and capable of pivoting about two axes.

44. The invention of claim 40 which further comprises:

a pair of struts, each of said struts having two ends, the first end of one of said struts being coupled to one of said first pair of pivotal legs and the first end of the other of said struts being coupled to the other of said first pair of pivotal legs, the second end of the one said strut being pivotally coupled to said table top and capable of pivoting about two axes and the second end of the other said strut being pivotally coupled to said table top and capable of pivoting about two axes.

45. The invention of claim 40 wherein said table top includes a bottom surface, and said first pair of pivotal legs have a first position folded against the bottom surface and said second pair of pivotal legs have a first position folded against the bottom surface, said second pair of pivotal legs being capable of supporting said table top.

* * * * *

UNITED STATES PATENT AND TRADEMARK OFFICE

CERTIFICATE OF CORRECTION

PATENT NO. : 6,120,397
DATED : September 19, 2000
INVENTOR(S) : David Lee Julian It is certified that error appears in the above-identified patent and that said Letters Patent is hereby corrected as shown below:

Column 7,
Line 11, please delete the word "first" and insert in lieu thereof -- third --.
Line 63, please change "of claim 26" to -- of claim 24 --.
Line 65, please change "of claim 28" to -- of claim 26 --.

Column 8,
Line 1, please change "of claim 30" to -- of claim 28 --.

Signed and Sealed this

Seventeenth Day of June, 2003

JAMES E. ROGAN
*Director of the United States Patent and Trademark Office*